United States Patent [19]

Sung et al.

[11] Patent Number: 4,659,336

[45] Date of Patent: Apr. 21, 1987

[54] MOTOR FUEL COMPOSITION

[75] Inventors: Rodney L. Sung, Fishkill; Michael A. Caggiano, Chelsea; Milton D. Behrens, Fishkill, all of N.Y.

[73] Assignee: Texaco Inc., White Plains, N.Y.

[21] Appl. No.: 845,719

[22] Filed: Mar. 28, 1986

[51] Int. Cl.[4] ..... C10L 1/22

[52] U.S. Cl. ..... 44/62; 44/63; 44/71

[58] Field of Search ..... 44/63, 71, 62; 252/392; 562/564

[56] References Cited

U.S. PATENT DOCUMENTS

| | | | |
|---|---|---|---|
| 3,455,832 | 7/1969 | Davis | 44/63 |
| 3,920,698 | 11/1975 | Haemmerle et al. | 44/63 |
| 3,980,448 | 9/1976 | Haemmerle et al. | 44/63 |
| 4,419,105 | 12/1983 | Sung | 44/71 |
| 4,477,261 | 10/1984 | Sung | 44/71 |
| 4,536,189 | 8/1985 | Sung | 44/63 |
| 4,581,040 | 4/1986 | Sung et al. | 44/63 |
| 4,604,103 | 8/1986 | Campbell | 44/72 |

*Primary Examiner*—Mrs. Y. Harris-Smith

*Attorney, Agent, or Firm*—Robert A. Kulason; James J. O'Loughlin; Robert B. Burns

[57] ABSTRACT

A motor fuel composition comprising a mixture of hydrocarbons in the gasoline boiling range containing in combination a reaction product component and a polyolefin polymer/copolymer component is described. The reaction product component is the reaction product of maleic anhydride, a polyether polyamine, and a hydrocarbyl polyamine. The polyolefin polymer/copolymer component is the polymer, copolymer, or corresponding hydrogenated polymer or copolymer of a $C_2$–$C_6$ unsaturated hydrocarbon, said polymer or copolymer having a molecular weight in the range of 500–3500, preferably 650–2600.

18 Claims, No Drawings

MOTOR FUEL COMPOSITION

BACKGROUND OF THE INVENTION

1. Field of the Invention

The instant invention relates to a motor fuel composition containing a reaction product and a polyolefin polymer/copolymer, and to a concentrate containing said reaction product and polymer/copolymer employed as a motor fuel additive. More particularly, the instant invention relates to a motor fuel composition containing: (I) the reaction product of maleic anhydride, a polyether polyamine, and a hydrocarbyl polyamine; and (II) at least one polyolefin polymer, copolymer, or corresponding hydrogenated polymer or copolymer of a $C_2$–$C_6$ hydrocarbon, said polymer/copolymer having an average molecular weight in the range of 500–3500, and to a motor fuel additive concentrate containing said reaction product and polymer/copolymer components.

Incomplete combustion of a hydrocarbonaceous motor fuel in an internal combustion engine is a common problem which generally results in the formation and accumulation of carbon deposits on various parts of the combustion chamber as well as on the fuel intake and exhaust systems of the engine. The presence of carbon deposits in the combustion chamber seriously reduces the operating efficiency of the engine. First, deposit accumulation within the combustion chamber inhibits heat transfer between the chamber and the engine cooling system. This leads to higher temperatures within the combustion chamber, resulting in increases in the end gas temperature of the incoming charge. Consequently, end gas auto-ignition occurs, which causes engine knock. In addition, the accumulation of carbon deposits within the combustion chamber reduces the volume of the combustion zone, causing a higher then design compression ratio in the engine. This, in turn, also results in serious engine knocking. A knocking engine does not effectively utilize the energy of combustion. Moreover, a prolonged period of engine knocking will cause stress fatigue and wear in vital parts of the engine.

The above-described phenomenon is characteristic of gasoline powered internal combustion engines. It is usually overcome by employing a higher octane gasoline for powering the engine, and hence has become known as the engine octane requirement increase (ORI) phenomenon. It would be highly advantageous if engine ORI could be substantially reduced or eliminated by preventing carbon deposits in the combustion chamber of the engine.

Another problem relates to the accumulation of carbon deposits in the carburetor which tend to restrict the flow of air through the carburetor at idle and at low speeds, resulting in an overrich fuel mixture. This condition also promotes incomplete fuel combustion and leads to rough engine idling and engine stalling. Excessive hydrocarbon and carbon monoxide exhaust emissions are also produced under these conditions. It would be desirable from the standpoint of engine operability and overall air quality to provide a motor fuel composition which minimizes or overcomes the above-described problems.

2. Information Disclosure Statement

Co-assigned U.S. Appl. Ser. No. 821,727, filed on Jan. 23, 1986 (incorporated herein by reference) discloses the use of the reaction product of maleic anhydride, a polyether polyamine, and a hydrocarbyl polyamine in a gasoline motor fuel to reduce engine ORI and provide carburetor detergency;

U.S. Pat. No. 4,357,148 discloses the use of the combination of an oil-soluble aliphatic polyamine component containing at least one olefinic polymer chain and having a molecular weight range of 600–10,000, and a polymeric component which may be a polymer, copolymer, hydrogenated polymer or copolymer, or mixtures thereof having a molecular weight range of 500–1500 to reduce or inhibit ORI in motor fuels;

U.S. Pat. No. 4,191,537 discloses the use of a hydrocarbyl poly(oxyalkylene) aminocarbonate, having a molecular weight range of 600–10,000 and also having at least one basic nitrogen atom per aminocarbonate molecule, to reduce and control ORI in motor fuels;

Co-assigned U.S. Pat. No. 3,502,451 discloses the use of $C_2$–$C_6$ polyolefin polymers or hydrogenated polymers having a molecular weight range of 500–3500 in motor fuels to eliminate or reduce deposition on the intake valves and ports of an internal combustion engine;

U.S. Pat. No. 3,438,757 discloses the use of branched chain aliphatic hydrocarbyl amines and polyamines having molecular weights in the range 425–10,000 to provide detergency and dispersancy in motor fuels; and Co-assigned Rep. of South Africa Appl. No. 731911, filed on March 19, 1973, discloses a motor fuel composition comprising a polymeric component which is a polymer or copolymer of a $C_2$–$C_6$ unsaturated hydrocarbon having a molecular weight in the range 500–3500, and a hydrocarbyl-substituted amine or polyamine component, said motor fuel composition having effectiveness in reducing engine intake valve and port deposits.

SUMMARY OF THE INVENTION

The novel motor fuel composition of the invention comprises a mixture of hydrocarbons in the gasoline boiling range and: (I) from 0.0005–0.5 weight percent, preferably 0.01–0.05 weight percent of the reaction product of maleic anhydride, a polyether polyamine, and a hydrocarbyl polyamine; and (II) from 0.01–1.0 volume percent, preferably 0.05–0.10 volume percent of a polyolefin polymer or copolymer of a $C_2$–$C_6$ hydrocarbon having a molecular weight in the range of 500–3500.

The reaction product component of the invention is obtained by reacting:

(a) 1 mole of maleic anhydride;

(b) 1–2 moles, preferably 1.5 moles of a polyether polyamine represented by the formula $$NH_2-\underset{\substack{|\\ CH_3}}{CH}-CH_2-[O-\underset{\substack{|\\ CH_3}}{CH}-CH_2]_a-$$

$$-[O-CH_2-CH_2]_b-[O-CH_2-\underset{\substack{|\\ CH_3}}{CH}]_c-NH-Z$$

where b has a value from about 5–150, preferably from about 8–50, a+c has a value from about 2–20, preferably from about 2.5–10, and Z is selected from the group consisting of (i) a hydrogen atom;

(ii) an alkyl radical having from 1–6 carbon atoms;

(iii) a polyether radical of the formula $$-[O-\underset{\underset{CH_3}{|}}{CH}-CH_2]_a-[O-CH_2-CH_2]_b-[O-CH_2-\underset{\underset{CH_3}{|}}{CH}]_c-NH_2$$

where b has a value from about 5–150, preferably from about 8–50, and a+c has a value from about 2–20; preferably from about 2.5–10;

(iv) an alkylene polyether radical of the formula $$-R_1-[O-\underset{\underset{CH_3}{|}}{CH}-CH_2]_a-[O-CH_2-CH_2]_b-[O-CH_2-\underset{\underset{CH_3}{|}}{CH}]_c-NH_2$$

where $R_1$ is an alkylene radical having from about 1–6, preferably 1–3 carbon atoms, b has a value from about 5–150, preferably from about 8–50, and a+c has a value from about 2–20 preferably from about 2.5–10; and (v) a radical of the formula $$R_2(NH-R_3)_x-$$

where $R_2$ is an alkyl radical having from about 1–24, preferably 12–20 carbon atoms, $R_3$ is an alkylene radical having from about 1–6 carbon atoms, and x has a value from about 1–10, preferably from about 1–5; and (c) 1–2 moles, preferably 1 mole of a hydrocarbyl polyamine of the formula $$R_2(NH-R_3)_x-NH_2$$

where $R_2$ is a alkyl radical having from about 1–24, preferably 12–20 carbon atoms, $R_3$ is an alkylene radical having from about 1–6 carbon atoms, and x has a value from about 1–10, preferably 1–5.

In a preferred embodiment, the reaction product component of the instant invention is obtained by reacting maleic anhydride, a polyether diamine of the formula:

$$NH_2-\underset{\underset{CH_3}{|}}{CH}-CH_2-[O-\underset{\underset{CH_3}{|}}{CH}-CH_2]_a-$$

$$-[O-CH_2-CH_2]_b-[O-CH_2-\underset{\underset{CH_3}{|}}{CH}]_c-NH_2$$

where b has a value from about 5 to 150, preferably from about 8 to 50, and a+c has a value from about 2 to 20, preferably from about 2.5 to 10, and a n-alkyl-alkylene diamine represented by the formula:

$$R-NH-(CH_2)_n-NH_2$$

where R is an aliphatic hydrocarbon radical having from about 8 to 24 carbon atoms, preferably from about 12 to 20 carbon atoms, and n has a value from about 1 to 5, and preferably has a value of 3.

The polyolefin polymer/copolymer component of the invention may be a polymer, copolymer, or corresponding hydrogenated polymer or copolymer of a $C_2$–$C_6$ hydrocarbon, said polymer or copolymer having an average molecular weight range from about 500–3500, preferably from about 650–2600. In a preferred embodiment, the polymer/copolymer component is either a polypropylene having an average molecular weight of about 750–1000, preferably about 800, or a polyisobutylene having an average molecular weight of about 1000–1500, preferably about 1300.

The instant invention is also directed to a concentrate comprising a total of 1.0–75.0 wt.%, preferably 5.0–35.0 wt.% of the above-described reaction product and polymer/copolymer components dissolved in a suitable solvent, said concentrate being employed as a motor fuel additive to produce the ORI-inhibiting motor fuel composition of the instant invention.

DETAILED EMBODIMENTS OF THE INVENTION

The novel motor fuel composition of the invention comprises a mixture of hydrocarbons in the gasoline boiling range and: (I) a maleic anhydride-polyether polyamine-hydrocarbyl polyamine reaction product; and (II) at least one polyolefin polymer, copolymer, or corresponding hydrogenated polymer or copolymer of a $C_2$–$C_6$ hydrocarbon.

The reaction product component of the motor fuel composition of the invention is prepared by reacting maleic anhydride, a polyether polyamine, preferably a polyether diamine, and a hydrocarbyl polyamine, preferably an n-alkyl-alkylene diamine. The polyether polyamine reactant may be generally represented by the formula:

$$NH_2-\underset{\underset{CH_3}{|}}{CH}-CH_2-[O-\underset{\underset{CH_3}{|}}{CH}-CH_2]_a-$$

$$-[O-CH_2-CH_2]_b-[O-CH_2-\underset{\underset{CH_3}{|}}{CH}]_c-NH-Z$$

where b has a value from about 5–150, preferably from about 8–50, a+c has a value from about 2–20, preferably from about 2.5–10, and Z is selected from the group consisting of (i) a hydrogen atom;

(ii) an alkyl radical having from 1–6 carbon atoms;

(iii) a polyether radical of the formula $$-[O-\underset{\underset{CH_3}{|}}{CH}-CH_2]_a-[O-CH_2-CH_2]_b-[O-CH_2-\underset{\underset{CH_3}{|}}{CH}]_c-NH_2$$

where b has a value from about 8–50, preferably from about 8–50, a+c has a value from about 2–20, preferably from about 2.5–10;

(iv) an alkylene polyether radical of the formula $$-R_1-[O-\underset{\underset{CH_3}{|}}{CH}-CH_2]_a-[O-CH_2-CH_2]_b-[O-CH_2-\underset{\underset{CH_3}{|}}{CH}]_c-NH_2$$

where $R_1$ is an alkylene radical having from about 1–6, preferably 1–3 carbon atoms, b has a value from about 5–150, preferably about 8–50, and a+c has a value from about 2–20, preferably from about 2.5–10; and (v) a radical of the formula $$R_2(NH-R_3)_x-$$

where $R_2$ is an alkyl radical having from about 1–24, preferably 12–20 carbon atoms, $R_3$ is an alkylene radical having from about 1–6 carbon atoms, and x has a value from about 1–10, preferably from about 1–5.

The preferred polyether polyamine reactant is a polyether diamine of the formula:

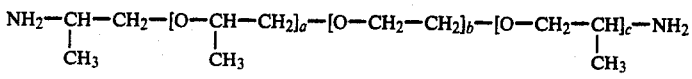

where b has a value from about 5 to 150, preferably from about 8 to 50, and a+c has a value from about 2 to 20, preferably from about 2.5 to 10. Polyether diamines suitable for use in preparing the reaction product component include polyether diamines commercially available from Texaco Chemical Co. under the JEFFAMINE ED series trade name. Examples of these polyether diamines include JEFFAMINE ED-600, ED-900, ED-2001, ED-4000, and ED-6000. A critical feature in the reaction product component is the presence of a substantial portion of oxyethylene ether moieties provided by the prescribed polyether polyamine reactant. The most preferred polyether diamine reactant for use in preparing the reaction product component is as described above, where b has an approximate value of 40.5, and a+c has an approximate value of 2.5.

The hydrocarbyl polyamine reactant may be generally represented by the formula:

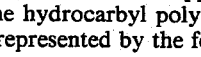

where $R_2$ is an alkyl radical having from about 1–24, preferably 12–20 carbon atoms, $R_3$ is an alkylene radical having from about 1–6 carbon atoms, and x has a value from about 1–10, preferably 1–5. The preferred hydrocarbyl polyamine reactant for use is a n-alkyl-alkylene diamine of the formula:

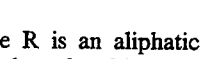

where R is an aliphatic hydrocarbon radical having from about 8 to 24 carbon atoms, preferably from about 12 to 20 carbon atoms, and n has a value from about 1 to 5, preferably having a value of 3. N-alkyl-alkylene diamines suitable for use in preparing the reaction product of the instant invention include aliphatic diamines commercially available from Akzo Chemie America Co. under the DUOMEEN series trade name. Examples of such n-alkyl-alkylene diamines include:

n-coco-1,3-diaminopropane(DUOMEEN C);
n-soya-1,3-diaminopropane(DUOMEEN S);
n-tallow-1,3-diaminopropane(DUOMEEN I); and
n-oleyl-1,3-diaminopropane DUOMEEN OL).

The most preferred n-alkyl-alkylene diamine reactant for use in preparing the reaction product component of the instant invention is n-tallow-1,3 diaminopropane.

The reaction product component is prepared by first reacting about 1 to 2 moles, preferably 1 mole of maleic anhydride with about 1 to 2 moles, preferably 1.5 moles of the prescribed polyether polyamine. The reaction of maleic anhydride with the polyether polyamine is preferably carried out in the presence of a solvent. A preferred solvent is one which will distill with water azeotropically. Suitable solvents include hydrocarbons boiling in the gasoline boiling range of about 30° C. to about 200° C. Generally, this will include saturated and unsaturated hydrocarbons having from about 5 to about 10 carbon atoms. Specific suitable hydrocarbon solvents include hexane, cyclohexane, benzene, toluene, and mixtures thereof. Xylene is the preferred solvent. The solvent can be present in an amount of up to about 90% by weight of the total reaction mixture.

In a preferred method for preparing the reaction product component, about 1 mole of maleic anhydride and about 1.5 moles of polyether polyamine are combined with the solvent xylene and reacted at a temperature of about 100° C. The reaction mixture is maintained at this temperature for approximately 2 hours. The mixture is then cooled to about 60° C., whereupon 1 to 2 moles, preferably 1 mole, of the hydrocarbyl polyamine is added. The new mixture is then reacted at about 100° C. for approximately 2 hours. The reaction product can then be separated from the solvent using conventional means, or left in admixture with some or all of the solvent to facilitate addition of the reaction product to gasoline or another motor fuel composition. A substantial portion of the total reaction product mixture may be represented structurally as:

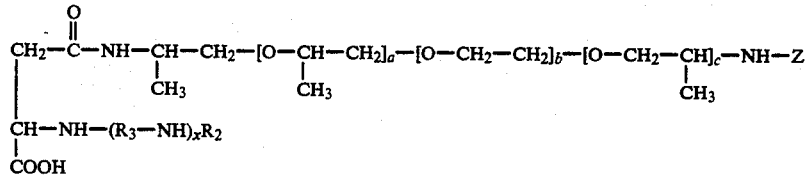

where Z, $R_2$, $R_3$, x, b, and a+c are as previously described.

The following examples illustrate the preferred method of preparing the reaction product component of the motor fuel composition of the instant invention. It will be understood that the following examples are merely illustrative, and are not meant to limit the invention in any way. In the examples, all parts are parts by weight unless otherwise specified.

EXAMPLE I

A reaction product was formed by reacting 9.8 parts of maleic anhydride, 689 parts of xylene, and 336.6 parts of the polyether diamine JEFFAMINE ED-2001 at 100° C. for 2 hours. JEFFAMINE ED-2001 is a polyether diamine of approximate molecular weight 2000 having the general formula:

$$NH_2-\underset{\underset{CH_3}{|}}{CH}-CH_2-[O-\underset{\underset{CH_3}{|}}{CH}-CH_2]_a-[O-CH_2-CH_2]_b-[O-CH_2-\underset{\underset{CH_3}{|}}{CH}]_c-NH_2$$

where b has an approximate value of 40.5, and a+c has an approximate value of 2.5. The mixture was thereafter cooled to about 60° C., and 37.4 parts of n-tallow-1,3-diaminopropane (DUOMEEN T) were added. The new mixture was then reacted at about 100° C. for 2 hours to produce the final reaction product. The reaction product was filtered and stripped of remaining solvent under vacuum. Spectroscopic analysis indicated that a substantial portion of the reaction product of the instant example may be represented structurally as:

$$\begin{array}{l} \qquad\qquad\quad O \\ \qquad\qquad\quad \| \\ CH_2-C-NH-\underset{\underset{CH_3}{|}}{CH}-CH_2-[O-\underset{\underset{CH_3}{|}}{CH}-CH_2]_a-[O-CH_2-CH_2]_b-[O-CH_2-\underset{\underset{CH_3}{|}}{CH}]_c-NH_2 \\ | \\ \underset{\underset{COOH}{|}}{CH}-NH-(CH_2)_3-NH-\text{tallow} \end{array}$$

where b has an approximate value of 40.5, and a+c has an approximate value of 2.5.

EXAMPLE II

A reaction product was formed by reacting 20 parts of the maleic anhydride, 689 parts of xylene, and 284 parts of the polyether diamine JEFFAMINE ED-900 at 100° C. for 2 hours. JEFFAMINE ED-900 is a polyether diamine of approximate molecular weight 900 having the general formula:

$$NH_2-\underset{\underset{CH_3}{|}}{CH}-CH_2-[O-\underset{\underset{CH_3}{|}}{CH}-CH_2]_a-[O-CH_2-CH_2]_b-[O-CH_2-\underset{\underset{CH_3}{|}}{CH}]_c-NH_2$$

where b has an approximate value of 15.5, and a+c has an approximate value of 2.5. The mixture was thereafter cooled to about 60° C., and 75 parts of n-tallow-1,3-diaminopropane (DUOMEEN T) were added. The new mixture was then reacted at about 100° C. for 2 hours to produce the final reaction product. The reaction product was filtered and stripped of remaining solvent under a vacuum.

EXAMPLE III

A reaction product was formed by reacting 24.5 parts of maleic anhydride, 692 parts of xylene, and 236.7 parts of the polyether diamine JEFFAMINE ED-600 at 100° C. for 2 hours. JEFFAMINE ED-600 is a polyether diamine of approximate molecular weight 600 having the general formula:

$$NH_2-\underset{\underset{CH_3}{|}}{CH}-CH_2-[O-\underset{\underset{CH_3}{|}}{CH}-CH_2]_a-[O-CH_2-CH_2]_b-[O-CH_2-\underset{\underset{CH_3}{|}}{CH}]_c-NH_2$$

where b has an approximate value of 8.5, and a+c has an approximate value of 2.5. The mixture was thereafter cooled to about 60° C., and 93.5 parts of n-tallow-1,3 diaminopropane (DUOMEEN T) were added. The new mixture was then reacted at about 100° C. for 2 hours to produce the final reaction product. The reaction product was filtered and stripped of remaining solvent under a vacuum.

EXAMPLE IV

A reaction product was formed by reacting 32.7 parts of maleic anhydride, 516 parts of xylene, and 315.5 parts of the polyether diamine JEFFAMINE ED-600 at 100° C. for 2 hours. JEFFAMINE ED-600 is a polyether diamine of approximate molecular weight 600 having the general formula:

$$NH_2-\underset{\underset{CH_3}{|}}{CH}-CH_2-[O-\underset{\underset{CH_3}{|}}{CH}-CH_2]_a-[O-CH_2-CH_2]_b-[O-CH_2-\underset{\underset{CH_3}{|}}{CH}]_c-NH_2$$

where b has an approximate value of 8.5, and a+c has an approximate value of 2.5. The mixture was thereafter cooled to about 60° C., and 107 parts of n-oleyl-1,3-diaminopropane (DUOMEEN OL) were added. The new mixture was then reacted at about 100° C. for 2 hours to produce the final reaction product. The reaction product was filtered and stripped of remaining solvent under vacuum.

EXAMPLE V

A reaction product was formed by reacting 19.6 parts of maleic anhydride, 518 parts of xylene, and 284 parts of the polyether diamine JEFFAMINE ED-900 at 100° C. for 2 hours. JEFFAMINE ED-900 is a polyether diamine of approximate molecular weight 900 having the general formula:

$$NH_2-\underset{\underset{CH_3}{|}}{CH}-CH_2-[O-\underset{\underset{CH_3}{|}}{CH}-CH_2]_a-[O-CH_2-CH_2]_b-[O-CH_2-\underset{\underset{CH_3}{|}}{CH}]_c-NH_2$$

where b has an approximate value of 15.5, and a+c has an approximate value of 2.5. The mixture was thereafter cooled to about 60° C., and 64.2 parts of n-oleyl-1,3-diaminopropane (DUOMEEN OL) were added. The new mixture was then reacted at about 100° C. for 2 hours to produce the final reaction product. The reaction product was filtered and stripped of remaining solvent under vacuum.

EXAMPLE VI

A reaction product was formed by reacting 9.8 parts of maleic anhydride, 518 parts of xylene and 336.6 parts of the polyether diamine JEFFAMINE ED-2001 at 100° C. for 2 hours. JEFFAMINE ED-2001 is a polyether diamine of approximate molecular weight 2000 having the general formula:

$$NH_2-\underset{\substack{|\\ CH_3}}{CH}-CH_2-[O-\underset{\substack{|\\ CH_3}}{CH}-CH_2]_a-[O-CH_2-CH_2]_b-[O-CH_2-\underset{\substack{|\\ CH_3}}{CH}]_c-NH_2$$

where b has an approximate value of 40.5, and a+c has an approximate value of 2.5. The mixture was thereafter cooled to about 60° C., and 32.1 parts of n-oleyl-1,3 diaminopropane (DUOMEEN OL) were added. The mixture was then reacted at about 100° C. for 2 hours to produce the final reaction product. The reaction product was filtered and stripped of remaining solvent under vacuum.

The polymer component of the motor fuel composition of the instant invention is a polyolefin polymer, copolymer, or corresponding hydrogenated polymer or copolymer of a $C_2$–$C_6$ unsaturated hydrocarbon. The polymer component is prepared from monoolefins and diolefins or copolymers thereof having an average molecular weight in the range from about 500–3500, preferably aboout 650–2600. Mixtures of olefin polymers with an average molecular weight falling within the foregoing range are also effective. In general, the olefin monomers from which the polyolefin polymer component is prepared are unsaturated $C_2$–$C_6$ hydrocarbons. Specific olefins which may be employed to prepare the polyolefin polymer component include ethylene, propylene, isopropylene, butylene, isobutylene, amylene, hexylene, butadiene, and isoprene. Propylene, isopropylene, butylene, and isobutylene are particularly preferred for use in preparing the polyolefin polymer component. Other polyolefins which may be employed are those prepared by cracking polyolefin polymers or copolymers of high molecular weight to a polymer in the above-noted molecular weight range. Derivatives of the noted polymers obtained by saturating the polymers by hydrogenation are also effective and are a part of this invention. The word "polymers" is intended to include the polyolefin polymers and their corresponding hydrogenated derivatives.

Note that the average molecular weight range of the polymer component is a critical feature of the instant invention. The polyolefin polymer, copolymer, or corresponding hydrogenated polymer or copolymer component may have an average molecular weight in the range from about 500–3500, preferably from about 650–2600. The most preferred polymer components for use in the instant invention are polypropylene with an average molecular weight in the range of about 750–1000, preferably about 800, and polyisobutylene with an average molecular weight in the range of about 1000–1500, preferably about 1300.

In general, the reaction product component is employed in the motor fuel composition of the instant invention at a concentration ranging from about 0.0005 to about 0.5 weight percent. More effective fuel compositions of the instant invention are obtained when the reaction product component is employed at concentrations ranging from 0.001 to about 0.1 weight percent, with the preferred concentration range being from about 0.01–0.05 weight percent. The polymer, copolymer, or corresponding hydrogenated polymer or copolymer component is employed in the motor fuel composition of the instant invention at a concentration ranging from about 0.01 to 1.0 volume percent, based on the total volume of the motor fuel composition. More effective fuel compositions of the instant invention are obtained when the polymer component is employed at concentrates ranging from 0.05 to 0.15 volume percent, with the most preferred concentration range being from about 0.05 to 0.10 volume percent.

It has been found that a motor fuel composition containing the above-described polymer and reaction product components is surprisingly effective in minimizing and reducing the ORI of a gasoline internal combustion engine. In fact, it has been found that a motor fuel composition containing the combination of the reaction product and polymer components exhibits a surprising and unexpected improvement in reduced ORI for the additive-containing gasoline as compared to motor fuel compositions containing the reaction product or polymer additive separately. The improvement is particularly significant since it is known that the polymer component employed alone degrades the octane value of unleaded gasoline.

The improvement has been demonstrated in engine testing where the performance characteristics of a base motor fuel composition and an improved motor fuel composition of the instant invention were compared. The specific engine testing was done using a 2.0 liter Chevrolet (Throttle Body) four cylinder engine (Chevy Test). This testing correlates well with results obtained via road simulation tests.

The base motor fuel employed in these tests (herein designated as Base Fuel A) was a regular grade gasoline essentially unleaded (less than 0.05 g of tetraethyl lead per gallon), and comprised a mixture of hydrocarbons boiling in the gasoline boiling range consisting of about 22% aromatic hydrocarbons, 11% olefinic carbons, and 67% paraffinic hydrocarbons, boiling in the range from about 90° F. to 450° F.

In preparing motor fuels for the Chevy Test, a suitable amount of reaction product component of the instant invention was added to Base Fuel A in the following manner: First, the reaction product was dissolved in a minor amount of a polar solvent, and the resulting solution containing the reaction product was mixed with the base fuel. In the test examples, approximately 1.6% by volume of polar solvent based on the total volume of the fuel composition was employed. The polar solvent employed in the test examples was methanol. The reaction product-polar solvent mixture was thereafter dissolved in a major amount of Base Fuel A. In general, from about 0.1–3.0 volume percent of polar solvent based on the volume of the fuel composition may be employed. Suitable polar solvents for use include acetone, methyl ethyl ketone, ethanol, methanol, isopropanol, or t-butyl alcohol.

In preparing motor fuels for the Chevy Test, a suitable amount of polymer component of the instant invention was added to Base Fuel A as follows: First, the polymer component employed was dissolved in a minor amount of a polar solvent, and the resulting solution containing the polymer was mixed with the base fuel. In general, about 0.1–10.0 volume percent of polar solvent containing the polymer component (based on the volume of the fuel composition) may be employed. Suitable polar solvents for use include acetone, methyl ethyl ketone, ethanol, methanol, isopropanol, t-butyl alcohol, or mixtures thereof.

Examples VII and VIII set forth below are illustrative of motor fuel compositions of the instant invention, said motor fuel compositions comprising the above-described reaction product and polymer components. It will be understood that the following examples are merely illustrative, and are not meant to limit the invention in any way.

EXAMPLE VII

A motor fuel composition was obtained by mixing with Base Fuel A about 100 PTB of the reaction product component set forth in Example I (100 pounds of reaction product component per 1000 barrels of gasoline, equivalent to about 0.04 wt.% of the reaction product component based upon the weight of the fuel composition) and about 0.075% by volume of polypropylene polymer component of a molecular weight of about 800.

EXAMPLE VIII

A motor fuel composition was obtained by mixing with Base Fuel A about 620 PTB of the reaction product components set forth in Example I and about 1038 PTB of polyisobutylene of a molecular weight of about 1300. The polyisobutylene component was added to Base Fuel A by mixing it with a 50/50 mixture of t-butyl alcohol and methanol, said polar solvent-polymer mixture comprising about 9.5 volume percent of the total fuel mixture.

ORI was determined for Base Fuel A, Base Fuel A containing 100 PTB of the reaction component alone (as set forth in Example I), and a motor fuel composition of the instant invention containing both additive components (as set forth by Example VII) using the Chevy Test. The Chevy Test employs a 2.0 liter Chevrolet in-line four cylinder engine with a cast alloy iron cylinder head having separate intake and exhaust ports for each cylinder. An electronic fuel injection system controlled the fuel flow to each engine cylinder by monitoring various engine operating parameters (e.g. manifold absolute pressure, throttle valve position, coolant temperature, engine r.p.m., and exhaust gas oxygen content). The test procedure is specifically adapted for the determination of engine ORI, i.e., the difference between the octane requirement of the engine at the base point or clean engine start-up and the octane requirement of the engine after the indicated periods of operation. The results obtained for Base Fuel A and the additive-containing fuels are combined and reported in Table I below. $\Delta ORI_1$ gives the difference in ORI between Base Fuel A and Base Fuel A containing the reaction product component alone. $\Delta ORI_2$ gives the difference in ORI between Base Fuel A and the fuel composition of the instant invention containing both of the prescribed additives.

TABLE I

CHEVY ENGINE TEST ORI RESULTS

| Engine Operation (Hours) | $\Delta$ ORI$_1$* | $\Delta$ ORI$_2$** |
|---|---|---|
| 25 | 0 | −4 |
| 50 | 0 | −1 |
| 75 | 0 | 3 |
| 100 | 0 | 5 |
| 125 | 1 | 4 |
| 150 | 2 | 7 |
| 175 | 2 | 6 |
| 200 | 3 | 8 |
| 250 | 3 | 8 |

*$\Delta ORI_1 = ORI_{(Base\ Fuel\ A)} - ORI_{(Base\ Fuel\ A+100\ PTB\ Example\ I)}$
**$\Delta ORI_2 = ORI_{(Base\ Fuel\ A)} - ORI_{(Example\ VII)}$ As indicated in Table I, the Chevy Test data show that the ORI of Base Fuel A containing 100 PTB of the reaction product component alone (Example I) was substantially higher than that of a motor fuel composition of the instant invention (Example VII). After about 100 hours of engine operation, the motor fuel composition containing the reaction product component alone gave an ORI number approximately the same as Base Fuel A alone. In contrast, a motor fuel composition of the instant invention (Example VII) gave an ORI number about 5 units lower than Base Fuel A alone. After about 250 hours of engine operation, the motor fuel composition containing the reaction product component alone gave an ORI number approximately 3 units lower than Base Fuel A alone, while the motor fuel composition of the instant invention gave an ORI number approximately 8 units lower than Base Fuel A alone. The data demonstrate that the motor fuel composition of the instant invention is a surprisingly superior motor fuel composition in terms of controlling or reducing the ORI of a gasoline internal combustion engine.

The motor fuel composition of the invention containing both the prescribed reaction product and polymer components is specifically intended for use in a spark ignition internal combustion engine. The base motor fuel or gasoline base stock preferably comprises a mixture of hydrocarbons boiling in the gasoline boiling range, preferably from about 90° F. to about 450° F. This base fuel may consist of straight-chain or branched chain paraffins, cycloparaffins, olefins, aromatic hydrocarbons, or mixtures thereof. The base fuel can be derived from, among others, straight run naphtha, polymer gasoline, natural gasoline, or from catalytically cracked or thermally cracked hydrocarbons and catalytically reformed stock. The composition and octane level of the base fuel are not critical and any conventional motor fuel base can be employed in the practice of this invention. In addition, the motor fuel composition may contain any of the additives generally employed in gasoline, such as anti-knock compounds, carburetor detergents, anti-icing additives, upper cylinder lubricating oils, and the like.

For convenience and economy in shipping and handling, it is useful to prepare a concentrate of the additives which can be added to a base fuel to produce the motor fuel composition of the instant invention. The concentrate may be prepared in a suitable liquid solvent containing from about 1.0–75.0 wt.% of the additive combination, namely the above-described reaction product and polymer components, with the preferred concentration being from about 5.0–35.0 wt%. Suitable solvents for use in the above-described concentrate include hydrocarbon solvents such as toluene and xylene, with xylene being preferred.

The terms and expressions employed herein are used as terms of description and not of limitation. It will be recognized that various modifications are possible within the scope of the claimed invention.

The invention claimed is:

1. A motor fuel composition comprising a mixture of hydrocarbons boiling in the gasoline boiling range containing:

(I) from about 0.0005–0.5 weight percent of the reaction product of:

(a) 1 mole of maleic anhydride;

(b) 1–2 moles of a polyether polyamine represented by the formula:

$$NH_2-\underset{\underset{CH_3}{|}}{CH}-CH_2-[O-\underset{\underset{CH_3}{|}}{CH}-CH_2]_a-[O-CH_2-CH_2]_b-[O-CH_2-\underset{\underset{CH_3}{|}}{CH}]_c-NH-Z$$

where b has a value from about 5–150, a+c has a value from about 2–20, and Z is selected from the group consisting of (i) a hydrogen atom;

(ii) an alkyl radical having from 1–6 carbon atoms;

(iii) a polyether radical of the formula $$-[O-\underset{\underset{CH_3}{|}}{CH}-CH_2]_a-[O-CH_2-CH_2]_b-[O-CH_2-\underset{\underset{CH_3}{|}}{CH}]_c-NH_2$$

where b has a value from about 5–150, and a+c has a value from about 2–20;

(iv) an alkylene polyether radical of the formula $$-R_1-[O-\underset{\underset{CH_3}{|}}{CH}-CH_2]_a-[O-CH_2-CH_2]_b-[O-CH_2-\underset{\underset{CH_3}{|}}{CH}]_c-NH_2$$

where $R_1$ is an alkylene radical having from about 1–6 carbon atoms, b has a value from about 5–150, and a+c has a value from about 2–20; and (v) a radical of the formula $$R_2(NH-R_3)_x-$$

where $R_2$ is an alkyl radical having from about 1–24 carbon atoms, $R_3$ is an alkylene radical having from about 1–6 carbon atoms, and x has a value from about 1–10; and (c) 1–2 moles of a hydrocarbyl polyamine of the formula $$R_2(NH-R_3)_x-NH_2$$

where $R_2$ is a alkyl radical having from about 1–24 carbon atoms, $R_3$ is an alkylene radical having from about 1–6 carbon atoms, and x has a value from about 1–10; and (II) from about 0.01–1.0 volume percent, based on the total volume of the motor fuel composition, of a polyolefin polymer, copolymer, or the corresponding hydrogenated polymer or copolymer, or mixtures thereof, of a $C_2$–$C_6$ unsaturated hydrocarbon, said polyolefin polymer or copolymer having a molecular weight in the range from about 500–3500.

2. A motor fuel composition according to claim 1, in which said reaction product component is obtained by reacting:

(a) 1 mole of maleic anhydride;

(b) about 1.5 moles of a polyether polyamine represented by the formula:

$$NH_2-\underset{\underset{CH_3}{|}}{CH}-CH_2-[O-\underset{\underset{CH_3}{|}}{CH}-CH_2]_a-[O-CH_2-CH_2]_b-[O-CH_2-\underset{\underset{CH_3}{|}}{CH}]_c-NH-Z$$

where b has a value from about 8–50, a+c has a value from about 2.5–10, and Z is selected from the group consisting of (i) a hydrogen atom;

(ii) an alkyl radical having from 1–6 carbon atoms;

(iii) a polyether radical of the formula $$-[O-\underset{\underset{CH_3}{|}}{CH}-CH_2]_a-[O-CH_2-CH_2]_b-[O-CH_2-\underset{\underset{CH_3}{|}}{CH}]_c-NH_2$$

where b has a value from about 8–50, and a+c has a value from about 2.5–10;

(iv) an alkylene polyether radical of the formula $$-R_1-[O-\underset{\underset{CH_3}{|}}{CH}-CH_2]_a-[O-CH_2-CH_2]_b-[O-CH_2-\underset{\underset{CH_3}{|}}{CH}]_c-NH_2$$

where $R_1$ is an alkylene radical having from about 1–3 carbon atoms, b has a value from about 8–50, and a+c has a value from about 2.5–10; and (v) a radical of the formula $$R_2(NH-R_3)_x-$$

where $R_2$ is an alkyl radical having from about 12–20 carbon atoms, $R_3$ is an alkylene radical having from about 1–6 carbon atoms, and x has a value from about 1–5; and (c) about 1 mole of a hydrocarbyl polyamine of the formula $$R_2(NH-R_3)_x-NH_2$$

where $R_2$ is a alkyl radical having from about 12–20 carbon atoms, $R_3$ is an alkylene radical having from about 1–6 carbon atoms, and x has a value from about 1–5.

3. A motor fuel composition according to claim 1, in which said reaction product component is obtained by reacting:

(a) 1 mole of maleic anhydride;

(b) 1–2 moles of a polyether polyamine, where said polyether polyamine is a polyether diamine of the formula

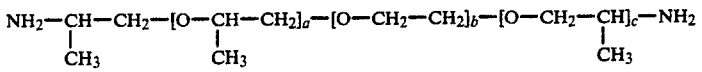

where b has a value from about 5–150 and a+c has a value from about 2–20; and (c) 1–2 moles of a hydrocarbyl polyamine, where said hydrocarbyl polyamine is a n-alkyl-alkylene diamine of the formula $$R—NH—(CH_2)_n—NH_2$$

where R is an aliphatic hydrocarbon radical having from about 8–24 carbon atoms and n has a value from about 1–5.

4. A motor fuel composition according to claim 3, in which said reaction product component is obtained by reacting 1 mole of said maleic anhydride with about 1.5 moles of said polyether diamine and about 1 mole of said n-alkyl-alkylene diamine.

5. A motor fuel composition according to claim 3, where b has a value from about 8 to 50, a+c has a value from about 2.5 to 10, n is equal to 3, and R is an aliphatic hydrocarbon radical having from about 12 to 20 carbon atoms.

6. A motor fuel composition according to claim 3, where said n-alkyl-alkylene diamine is selected from the group consisting of:
n-coco-1,3-diaminopropane;
n-soya-1,3-diaminopropane;
n-tallow-1,3-diaminopropane; and
n-oleyl-1,3-diaminopropane.

7. A motor fuel composition according to claim 1, in which said polyolefin polymer or copolymer component is derived from an unsaturated hydrocarbon selected from the group consisting of ethylene, propylene, isopropylene, butylene, isobutylene, amylene, hexylene, isoprene, and butadiene.

8. A motor fuel composition according to claim 1, in which said polyolefin polymer, copolymer, or corresponding hydrogenated polymer or copolymer component has a molecular weight in the range of about 650–2600.

9. A motor fuel composition according to claim 8, in which said polyolefin polymer component is a polypropylene having a molecular weight in the range of about 750–1000.

10. A motor fuel composition according to claim 9, where said polyolefin polymer component is a polypropylene with an average molecular weight of about 800.

11. A motor fuel composition according to claim 8, in which said polyolefin polymer component is a polyisobutylene having a molecular weight in the range of about 1000–1500.

12. A composition according to claim 11, in which said polyolefin polymer component is a polyisobutylene having an average molcular weight of about 1300.

13. A motor fuel composition according to claim 1, containing from about 0.001 to 0.10 weight percent of said reaction product component.

14. A motor fuel composition according to claim 1, containing from about 0.01 to 0.05 weight percent of said reaction product component.

15. A motor fuel composition according to claim 1, containing from about 0.05 to 0.15 volume percent of said polyolefin polymer or copolymer component.

16. A motor fuel composition according to claim 1, containing from about 0.05 to 0.10 volume percent of said polyolefin polymer or copolymer component.

17. A concentrate composition comprising 1.0–75.0 total weight percent of a mixture of the reaction product and polyolefin polymer or copolymer components of claim 1.

18. A concentrate composition according to claim 17, where said mixture of reaction product and polyolefin polymer or copolymer components is present in a concentration range of 5.0–35.0 total weight percent.

* * * * *